US009093794B2

(12) United States Patent
Curtis et al.

(10) Patent No.: US 9,093,794 B2
(45) Date of Patent: Jul. 28, 2015

(54) SPOON SHAPED ELECTROMAGNETIC INTERFERENCE FINGERS

(71) Applicant: Cisco Technology, Inc., San Jose, CA (US)

(72) Inventors: George Edward Curtis, San Jose, CA (US); Keith Frank Tharp, San Jose, CA (US); William Frank Edwards, Livermore, CA (US)

(73) Assignee: Cisco Technology, Inc., San Jose, CA (US)

( * ) Notice: Subject to any disclaimer, the term of this patent is extended or adjusted under 35 U.S.C. 154(b) by 100 days.

(21) Appl. No.: 13/852,221

(22) Filed: Mar. 28, 2013

(65) Prior Publication Data

US 2014/0295704 A1 Oct. 2, 2014

(51) Int. Cl.

| | |
|---|---|
| ***H01R 13/648*** | (2006.01) |
| ***H01R 13/6583*** | (2011.01) |
| ***H01R 13/658*** | (2011.01) |
| *H01R 12/72* | (2011.01) |
| *H01R 25/00* | (2006.01) |

(52) U.S. Cl.

CPC ..... *H01R 13/6583* (2013.01); *H01R 13/65802* (2013.01); *H01R 12/724* (2013.01); *H01R 25/006* (2013.01); *H01R 2201/06* (2013.01)

(58) Field of Classification Search

USPC ..... 439/607.01, 607.17, 607.2, 607.22, 439/607.35

See application file for complete search history.

(56) References Cited

U.S. PATENT DOCUMENTS

| | | | | |
|---|---|---|---|---|
| 6,416,361 | B1 * | 7/2002 | Hwang | 439/607.2 |
| 6,618,271 | B1 * | 9/2003 | Erickson et al. | 361/818 |
| 7,252,548 | B2 * | 8/2007 | Huang | 439/607.01 |
| 7,275,945 | B1 * | 10/2007 | Yi et al. | 439/181 |
| 7,455,554 | B2 * | 11/2008 | Long | 439/607.17 |
| 8,342,881 | B2 * | 1/2013 | Lang et al. | 439/607.01 |
| 8,444,439 | B2 * | 5/2013 | Cao et al. | 439/607.35 |
| 8,535,097 | B2 * | 9/2013 | Yen et al. | 439/607.27 |
| 2007/0212942 | A1 * | 9/2007 | Long | 439/608 |

* cited by examiner

*Primary Examiner* — Chandrika Prasad
(74) *Attorney, Agent, or Firm* — Merchant & Gould P.C.

(57) ABSTRACT

An integrated connector may be provided. The integrated connector may comprise a top portion, a front portion, and a side portion. The top portion may comprise a plurality of top fingers. The front portion may comprise a plurality of receptacles and a plurality of receptacle tabs respectively corresponding to the plurality of receptacles. The side portion may comprise at least one side finger comprising a main portion, a connector portion connected to the side portion, a tail portion, a top curved portion, and a bottom curved portion. The top fingers, the plurality of receptacle tabs, and the at least one side finger may be in electrical connection.

27 Claims, 8 Drawing Sheets

SPOON SHAPED ELECTROMAGNETIC INTERFERENCE FINGERS

BACKGROUND

Power Over Ethernet (POE) is a standardized system to provide electrical power along with data on Ethernet cabling. This allows a single cable to provide both data connection and electrical power to such devices as network hubs or closed-circuit TV cameras. Unlike standards such as Universal Serial Bus (USB) that also powers devices over data cables, POE allows long cable lengths.

BRIEF DESCRIPTION OF THE DRAWINGS

The accompanying drawings, which are incorporated in and constitute a part of this disclosure, illustrate various embodiments of the present disclosure. In the drawings.

DETAILED DESCRIPTION

Overview

Figure 1:
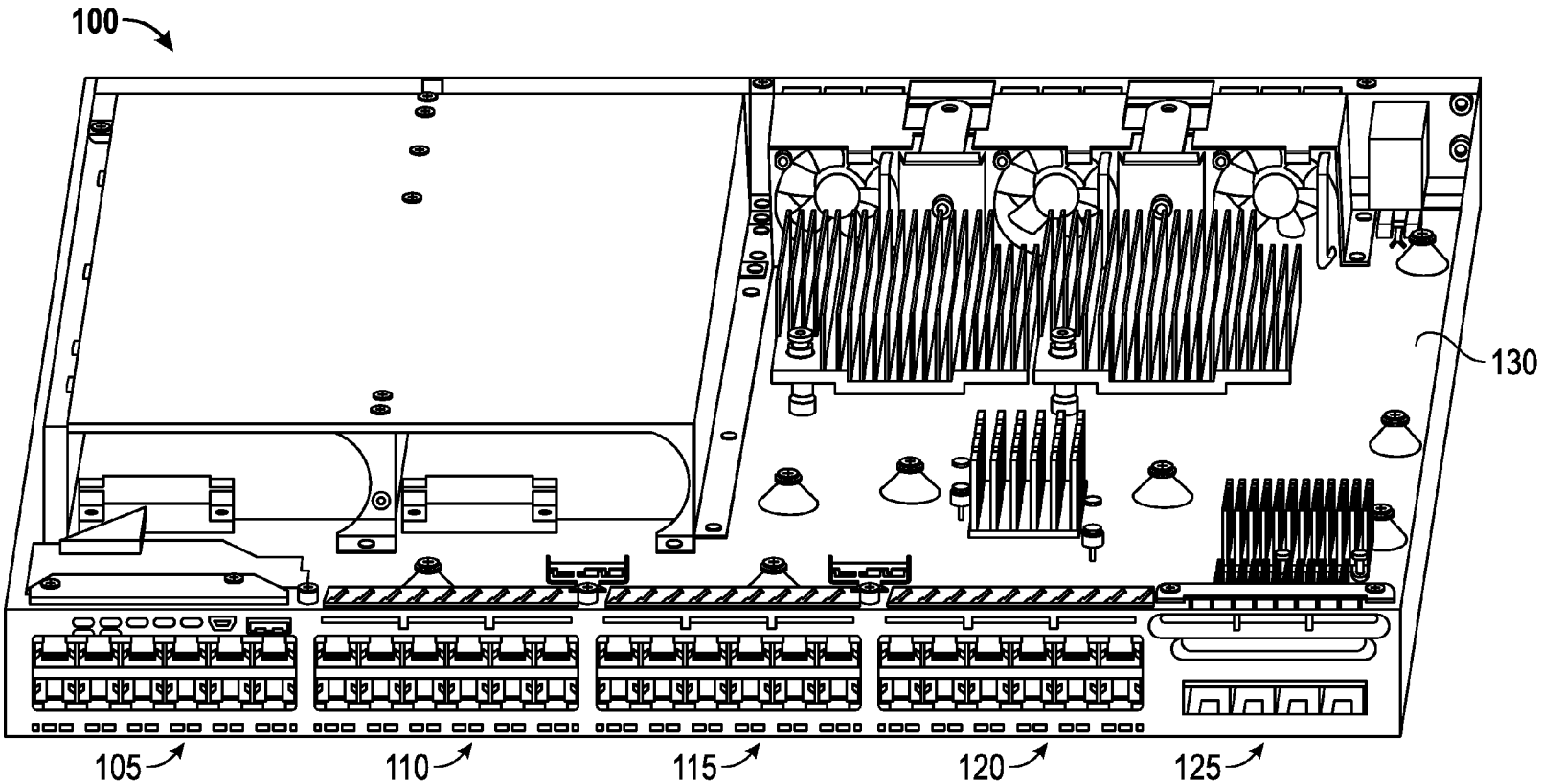
FIG. 1 shows a device.

An integrated connector may be provided. The integrated connector may comprise a top portion, a front portion, and a side portion. The top portion may comprise a plurality of top fingers. The front portion may comprise a plurality of receptacles and a plurality of receptacle tabs respectively corresponding to the plurality of receptacles. The side portion may comprise at least one side finger comprising a main portion, a connector portion connected to the side portion, a tail portion, a top curved portion, and a bottom curved portion. The top fingers, the plurality of receptacle tabs, and the at least one side finger may be in electrical connection.

Both the foregoing overview and the following example embodiment are examples and explanatory only, and should not be considered to restrict the disclosure's scope, as described and claimed. Further, features and/or variations may be provided in addition to those set forth herein. For example, embodiments of the disclosure may be directed to various feature combinations and sub-combinations described in the example embodiment.

Example Embodiments

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

Integrated connectors are used to interface a device to the world outside the device. When constructing the device, an Electromagnetic Interference (EMI) containment feature called a "Faraday Cage" may be designed into the device. A Faraday Cage may comprise an enclosure formed by conducting material or by a mesh of conducting material. This enclosure may block external static and non-static electric fields. Consequently, a Faraday Cage may comprise an approximation to an ideal hollow conductor. Externally or internally applied electromagnetic fields produce forces on charge carriers (i.e., electrons) within the ideal hollow conductor. The charges are redistributed accordingly (e.g., electric currents may be generated). Once the charges have been redistributed so as to cancel the applied electromagnetic field inside, the currents stop.

When constructing devices, the integrated connectors are not only used to interface the device to the outside world, but also become a part of the device's Faraday Cage. The integrated connectors may be included in the device's Faraday Cage at least because they may comprise at least a portion of the device's exterior. Consequently, each of the integrated connectors may comprise "fingers" that, once the device is constructed, cause the integrated connectors to electrically connect to each other to complete and extend the device's Faraday Cage. Accordingly, it is desirable or the fingers of integrated connectors to remain undamaged by the construction process of the device. Fingers may comprise elongated metallic leaf springs that may protrude from the integrated connectors cause the integrated connectors to electrically connect to each other to complete and extend the device's Faraday Cage.

Conventional integrated connectors that are spaced closely together have difficulty being assembled, installed, and replaced. This is because conventional fingers are not designed to prevent damage to each other during the installation process. Consequently, conventional fingers on the sides of integrated connectors subsequently installed on a circuit board may interfere with one another and break off or become bent during the installation process. One solution to this problem with conventional fingers is to allow more space between the integrated connectors on the circuit board. This is a costly solution that causes an undesirable increase in the size of the device.

Embodiments of the disclosure, however, may provide a three dimensional formed feature in the side fingers. This three dimensional formed feature may allow integrated connectors to be installed side by side, closer than current industry methods, without damage to the side fingers. As will be described in greater detail below, side fingers consistent with embodiments of the disclosure with this three dimensional formed feature may slide off of one another when they interfere and come into contact with one another during device construction.

FIG. 1 shows a device 100. As shown in FIG. 1, device 100 may comprise a first integrated connector 105, a second integrated connector 110, a third integrated connector 115, a fourth integrated connector 120, a field replaceable unit 125, and a circuit board 130. Device 100 may comprise, but is not limited to, a networking device such as a router, a switch, or any type device.

As device 100 is being constructed, the integrated connectors (e.g., first integrated connector 105, second integrated connector 110, third integrated connector 115, and fourth integrated connector 120) may be installed onto circuit board 130 from the top and either press fit or soldered in place. As the integrated connectors are pressed onto circuit board 130, side fingers of an integrated connector being pressed onto circuit board 130 may interfere and contact with side fingers of an integrated connector already installed on circuit board 130. Consistent with embodiments of the disclosure, the side finger may have a three dimensional formed feature that may cause the side finger of the two different integrated connectors to slide off of one another when they interfere and come into contact with one another during the aforementioned construction.

Vertical plane members may be placed between the integrated connectors. The vertical plane members may be electrically connected to a chassis of device 100. Side fingers from the integrated connectors may be in electrical contact with the vertical plane members thus grounding the integrated connectors to the chassis and extending the Faraday Cage.

Figure 2:
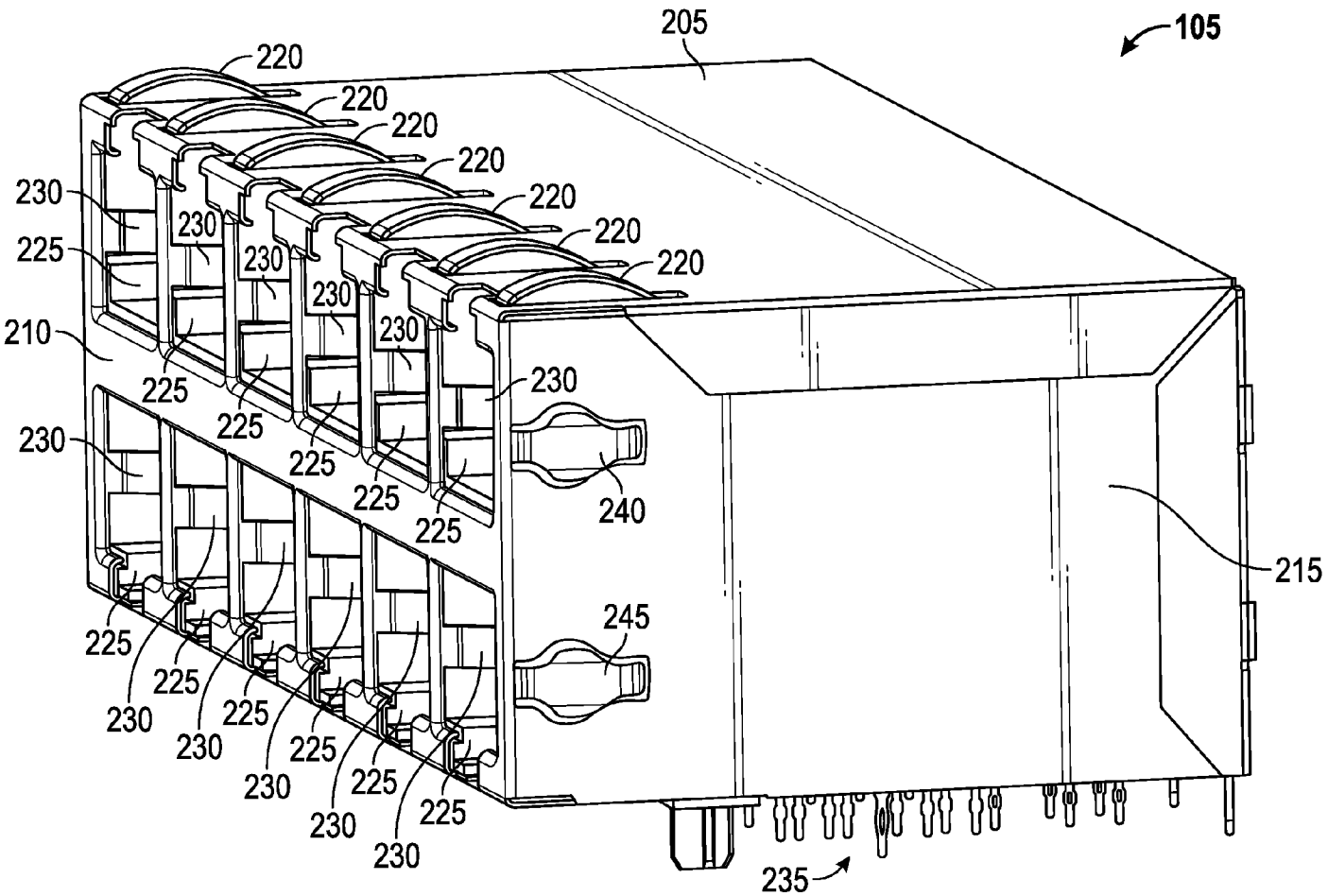
FIG. 2 shows an integrated connector.
Figure 3:
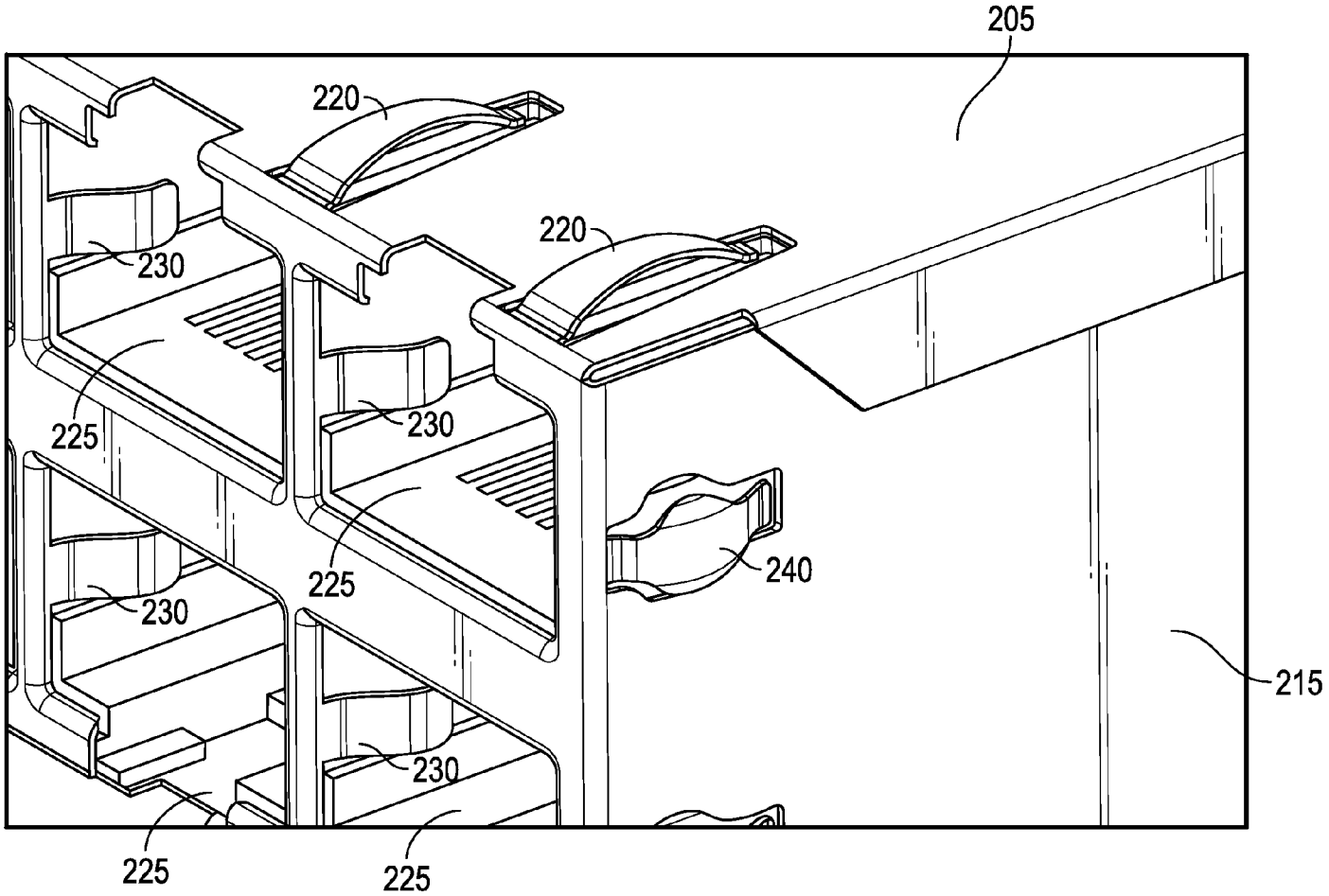
FIG. 3 shows a close up view of a section of an integrated connector.

FIG. 2 shows first integrated connector 105 and FIG. 3 shows a close up view of a section of first integrated connector 105. As shown in FIG. 2 and in FIG. 3, first integrated connector 105 may comprise a top portion 205, a front portion 210, and a side portion 215. Top portion 205 may comprise a plurality of top fingers 220. Top fingers may be conventional and without the aforementioned three dimensional formed feature consistent with embodiments of the disclosure.

Front portion 210 may comprise a plurality of receptacles 225 and a plurality of receptacle tabs 230. Side portion 215 may comprise a first side finger 240 and a second side finger 245. First side finger 240 and second side finger 245 may be of similar construction. Also, any of the other integrated connectors (e.g., second integrated connector 110, third integrated connector 115, and fourth integrated connector 120) may have side fingers similar to first side finger 240 and second side finger 245.

Plurality of receptacle tabs 230 may be electrically connected to front portion 210, which may be electrically connected to side portion 215, which may be grounded to device 100's chassis through first side finger 240 and second side finger 245 being in electrical connection to the vertical plane member grounded to device 100's chassis. During operation of device 100, jacks (e.g., RJ-45s) may be plugged into plurality of receptacle 225. Receptacle tabs 230 may contact corresponding jacks thus grounding the jacks to device 100's chassis. Plurality of receptacles 225 may respectively connect signal wires from the plurality of jacks to ones of circuit board connectors 235. Circuit board connectors 235 may be soldered or press fit onto circuit board 130.

Figure 4:
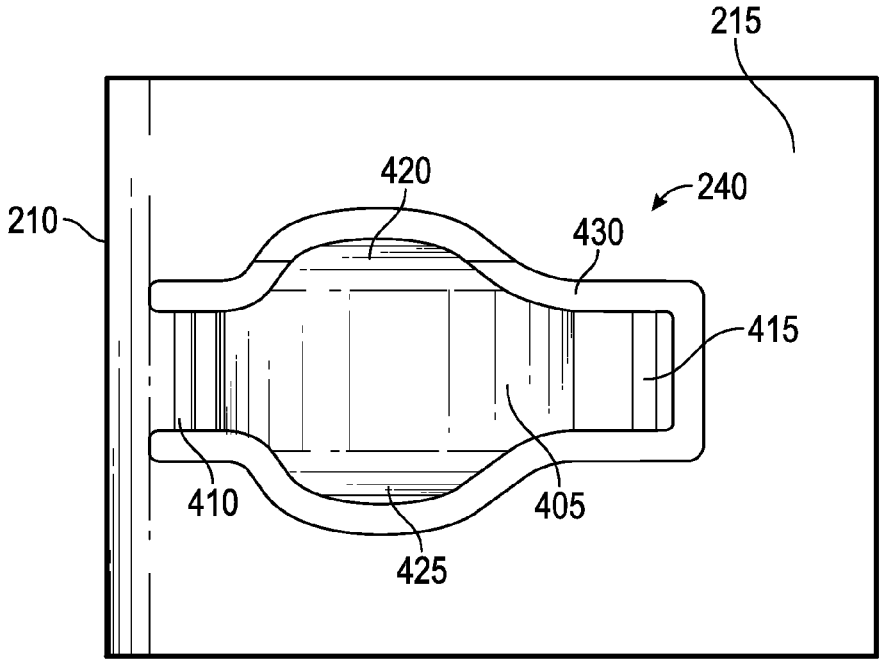
FIG. 4 shows a side finger.
Figure 5A:
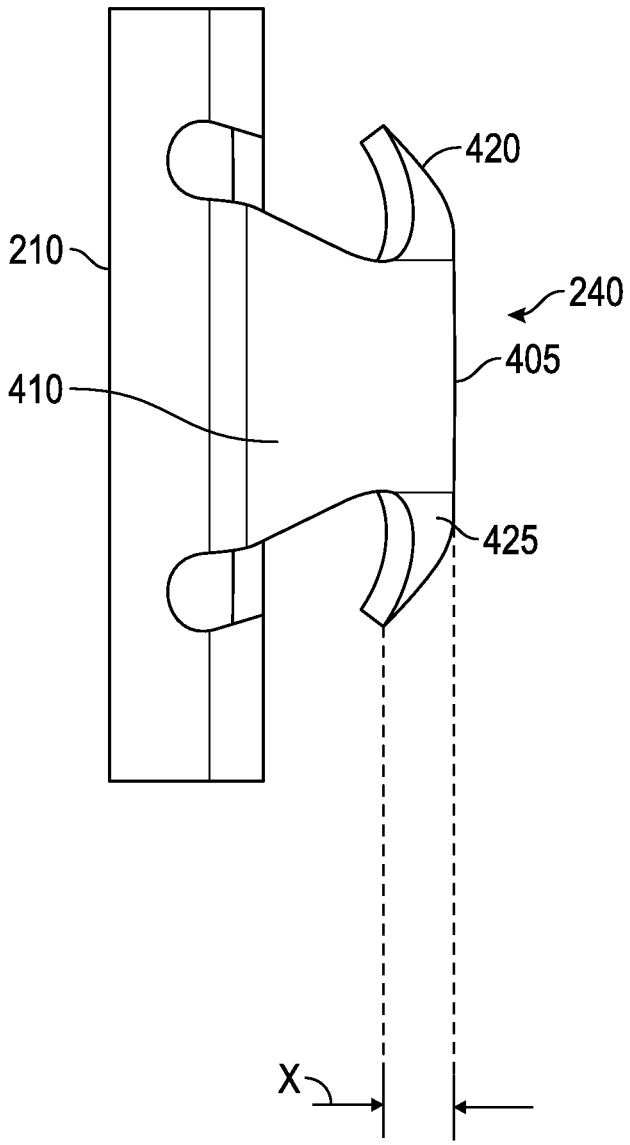
FIG. 5A shows a front view a side finger.
Figure 5B:
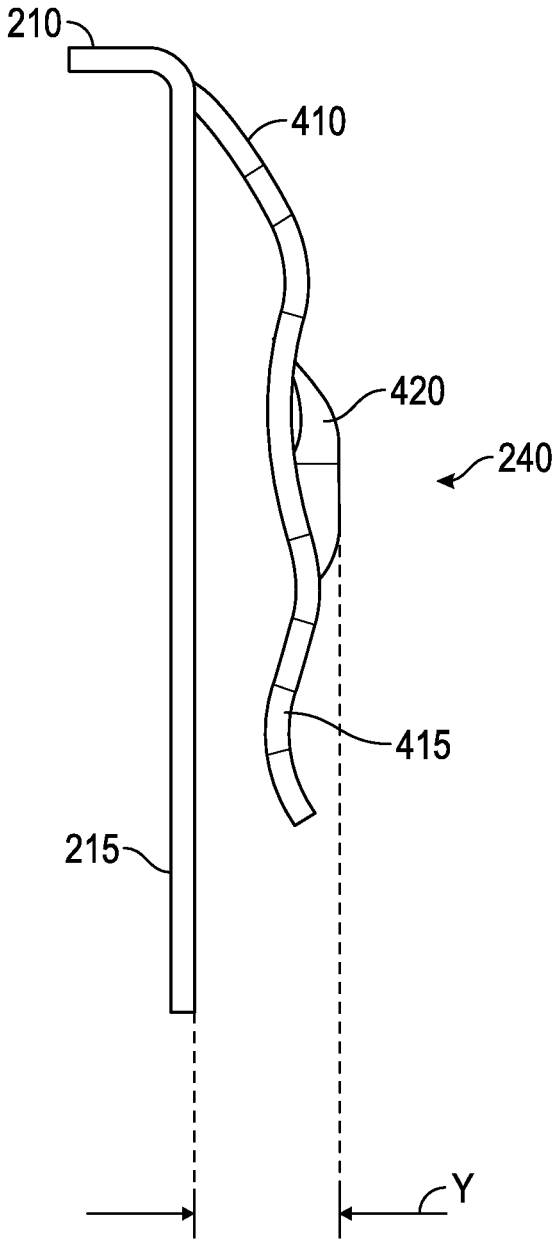
FIG. 5B shows a top view a side finger.
Figure 5C:
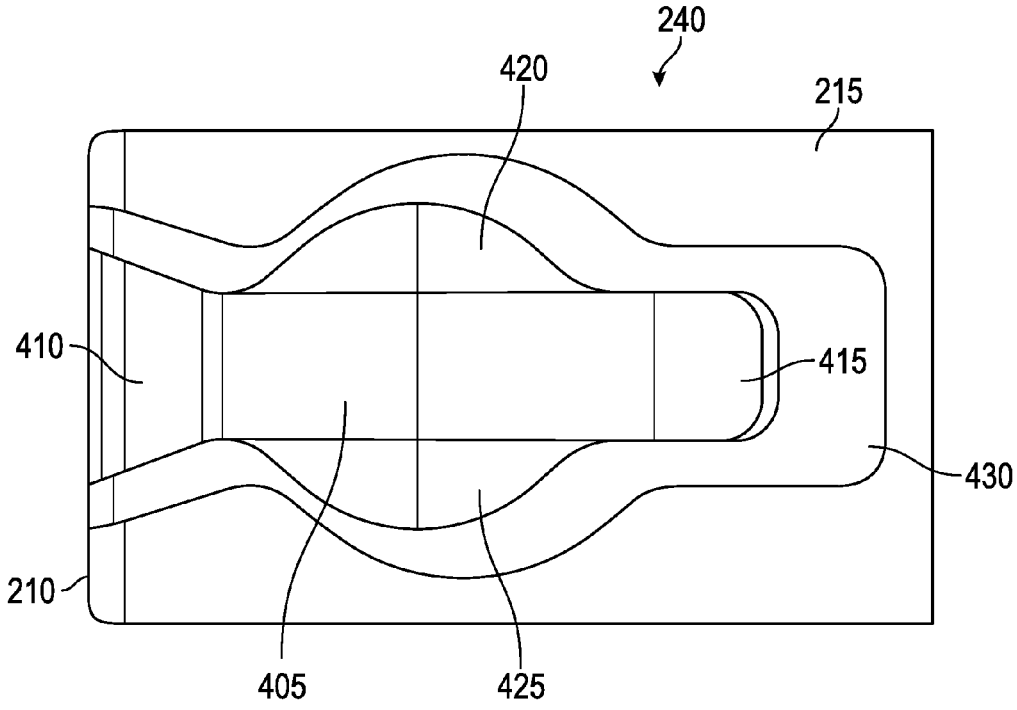
FIG. 5C shows a side view a side finger.

FIG. 4 shows first side finger 240 in greater detail. FIG. 5A shows a front view first side finger 240, FIG. 5B shows a top view first side finger 240, and FIG. 5C shows a side view first side finger 240. As shown in FIG. 4, FIG. 5A, FIG. 5B, and FIG. 5C, first side finger 240 may comprise a main portion 405, a connector portion 410, a tail portion 415, a top curved portion 420, and a bottom curved portion 425. Side portion 215 may further include a relief 430 to which first side finger 240 may retreat. Dimension "X" shown on FIG. 5A may comprise, but is not limited to, 0.02". Dimension "Y" shown on FIG. 5B may comprise, but is not limited to, 0.05".

Figure 6:
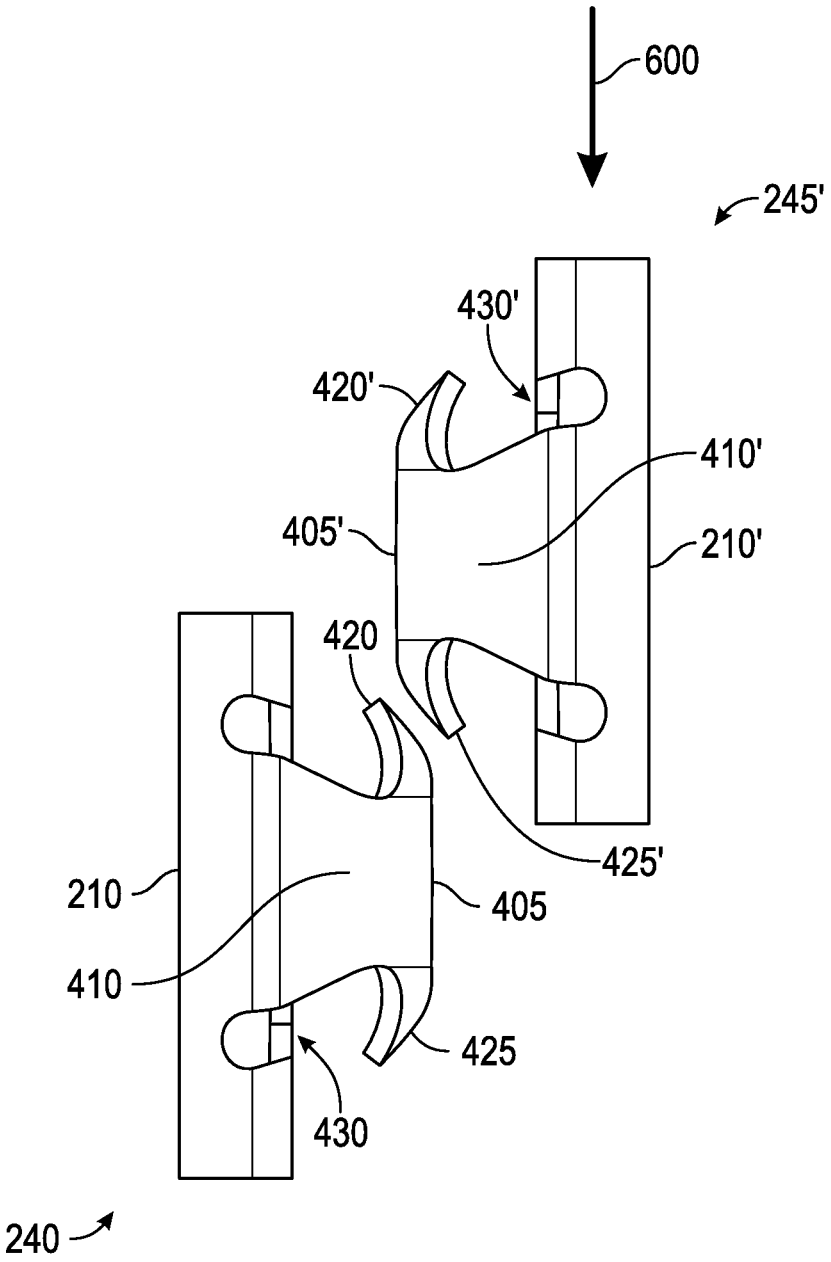
FIG. 6 shows side fingers interfering with one another.

FIG. 6 shows side fingers interfering with one another. As shown in FIG. 6, first integrated connector 105 may already be installed on circuit board 130 and second integrated connector 110 may be in the process of being installed on circuit board 130 during the construction of device 100. Second integrated connector 110 may comprise a second side finger 245' that may comprise a main portion 405', a connector portion 410', a tail portion 415', a top curved portion 420', and a bottom curved portion 425'. Second integrated connector 110 may also include a relief 430'.

With first integrated connector 105 already installed on circuit board 130, second integrated connector 110 may be pressed onto circuit board 130 from the top. As second integrated connector 110 is pressed onto circuit board 130, second side finger 245' may interfere and contact with first side finger 240 of first integrated connector 105. Consistent with embodiments of the disclosure, first side finger 240 and second side finger 245' may each have a three dimensional formed feature that may cause first side finger 240 and second side finger 245' to slide off of one another when they interfere and come into contact with one another during the construction of device 100. The three dimensional formed feature may comprise, but is not limited to, top curved portion 420, bottom curved portion 425, and main portion 405 causing first side finger 240 to have a "spoon-like" shape. Connector portion 410 may allow first side finger 240 to spring into relief 430 when first side finger 240 is interfered with and then spring back to its original position when first side finger 240 is no longer interfered with.

Consistent with embodiments of the disclosure, bottom curved portion 425' is configured to engage top curved portion 420 as second integrated connector 110 is pressed onto circuit board 130 from the top as indicated by a direction arrow 600. When this happens, bottom curved portion 425' slideably engages top curved portion 420 causing first side finger 240 to retreat into relief 430 and causing second side finger 245' to retreat into relief 430'. Then, as first side finger 240 and second side finger 245' slide past one another, connector portion 410 and connector portion 410', acting as springs, cause first side finger 240 and second side finger 245' to respectively snap back into their former place when first side finger 240 and second side finger 245' no longer interfere with one another.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

What is claimed is:

1. An apparatus comprising:

a top portion comprising a plurality of top fingers;

a front portion comprising a plurality of receptacles and a plurality of receptacle tabs respectively corresponding to the plurality of receptacles; and a side portion comprising at least one side finger extending from the side portion, the at least one side finger comprising a main portion, a connector portion, a top curved portion, and a bottom curved portion, wherein the top fingers, the plurality of receptacle tabs, and the at least one side finger are in electrical connection, wherein the top curved portion and the bottom curved portion each extend from the main portion and curve toward the side portion to form a spoon-like shape from the top curved portion, the bottom curved portion, and the main portion and wherein the connector portion connects the main portion to the side portion.

2. The apparatus of claim 1, wherein the least one side finger is proximate to a relief in the side portion.

3. The apparatus of claim 1, wherein the apparatus comprises an integrated connector.

4. The apparatus of claim 3, wherein the integrated connector is disposed on a circuit board.

5. The apparatus of claim 4, wherein the circuit board is disposed within a device.

6. The apparatus of claim 5, wherein the device comprises a networking device.

7. The apparatus of claim 6, wherein the networking device comprises one of the following: a network switch and a router.

8. The apparatus of claim 5, wherein the least one side finger is in electrical connection with a chassis of the device.

9. The apparatus of claim 5, wherein the least one side finger is in electrical connection with a member being in electrical connection with a chassis of the device.

10. The apparatus of claim 9, wherein the member is substantially perpendicular to the circuit board.

11. An apparatus comprising:

a first integrated connector comprising a first side portion comprising a first integrated connector side finger extending from the first integrated connector, the first integrated connector side finger comprising a first main portion, a first connector portion, a first top curved portion, and a first bottom curved portion, wherein the first top curved portion and the first bottom curved portion each extend from the first main portion and curve toward the first side portion to form a spoon-like shape from the first top curved portion, the first bottom curved portion, and the first main portion and wherein the first connector portion connects the first main portion to the first side portion; and a second integrated connector comprising a second side portion comprising a second integrated connector side finger extending from the second integrated connector, the second integrated connector side finger comprising a second main portion, a second connector portion, a second top curved portion, and a second bottom curved portion, wherein the second bottom curved portion is configured to engage the first top curved portion when the second integrated connector is installed on a circuit board comprising the first integrated connector, wherein the second top curved portion and the second bottom curved portion each extend from the second main portion and curve toward the second side portion to form a spoon-like shape from the second top curved portion, the second bottom curved portion, and the second main portion and wherein the second connector portion connects the second main portion to the second side portion.

12. The apparatus of claim 11, wherein the second bottom curved portion being configured to engage the first top curved portion comprises the second bottom curved portion being configured to slideably engage the first top curved portion when the second integrated connector is installed on the circuit board comprising the first integrated connector.

13. The apparatus of claim 11, wherein the first integrated connector side finger is configured to retreat into a first relief in the first side portion when the second bottom curved portion slideably engages the first top curved portion.

14. The apparatus of claim 11, wherein the first integrated connector side finger is configured to retreat into a first relief in the first side portion and the second integrated connector side finger is configured to retreat into a second relief in the second side portion when the second bottom curved portion slideably engages the first top curved portion.

15. The apparatus of claim 11, wherein the circuit board is disposed within a device.

16. The apparatus of claim 15, wherein the device comprises a networking device.

17. The apparatus of claim 16, wherein the networking device comprises one of the following: a network switch and a router.

18. An apparatus comprising:

a front portion; and a side portion electrically connected to the front portion, the side portion comprising at least one side finger comprising a main portion, a connector portion electrically connected to the side portion, a top curved portion, and a bottom curved portion, wherein the top curved portion and the bottom curved portion each extend from the main portion and curve toward the side portion to form a spoon-like shape from the top curved portion, the bottom curved portion, and the main portion and wherein the connector portion connects the main portion to the side portion.

19. The apparatus of claim 18, wherein the at least one side finger further comprises a tail portion.

20. The apparatus of claim 18, wherein the top curved portion is configured to retreat in to a relief in the side portion when the top curved portion is slideably engaged.

21. The apparatus of claim 18, wherein the apparatus comprises an integrated connector.

22. An apparatus comprising:

an integrated connector, the integrated connector comprising:

at least one side finger extending from the integrated connector, the at least one side finger comprising:

a main portion, a connector portion electrically connected to the integrated connector, a top curved portion, and a bottom curved portion, wherein the top curved portion and the bottom curved portion each extend from the main portion and curve toward the integrated connector to form a spoon-like shape from the top curved portion, the bottom curved portion, and the main portion and wherein the connector portion connects the main portion to the integrated connector.

23. The apparatus of claim 22, wherein the at least one side finger further comprises a tail portion.

24. The apparatus of claim 22, wherein the top curved portion is configured to retreat in to a relief in the integrated connector when the top curved portion is slideably engaged.

25. The apparatus of claim 22, wherein the integrated connector is disposed within a device.

26. The apparatus of claim 22, wherein the device comprises a networking device.

27. The apparatus of claim 26, wherein the networking device comprises one of the following: a network switch and a router.

* * * * *